US005236576A

United States Patent [19]

Gilman

[11] Patent Number: 5,236,576

[45] Date of Patent: Aug. 17, 1993

[54] CARBONACEOUS MINERAL REFINING PROCESS

[76] Inventor: Michael G. Gilman, 7703 Whiterim Ter., Potomac, Md. 20854

[21] Appl. No.: 745,671

[22] Filed: Aug. 16, 1991

Related U.S. Application Data

[63] Continuation-in-part of Ser. No. 607,400, Oct. 31, 1990, abandoned.

[51] Int. Cl.[5] ..... C10G 29/02; C10G 29/04

[52] U.S. Cl. ..... 208/292; 208/177; 208/294; 208/295; 208/297

[58] Field of Search ..... 208/177, 292, 294, 295, 208/297, 400, 403, 428, 251 R, 253

[56] References Cited

U.S. PATENT DOCUMENTS 2,213,272 9/1940 Dreyfus ..... 208/294

*Primary Examiner*—Theodore Morris
*Assistant Examiner*—Walter D. Griffin
*Attorney, Agent, or Firm*—Michael G. Gilman

[57] ABSTRACT

Reducing the ash content of hydrocarbonaceous materials containing bound oxygen by reaction with an oxygen deficient source of an oxygen-reactive element, except oxygen and hydrogen, preferably an oxygen deficient compound of silicon.

18 Claims, No Drawings

CARBONACEOUS MINERAL REFINING PROCESS

This application is a continuation in part of application Ser. No. 07/607,400, filed Oct. 31, 1990, now abandoned. The entire contents of said '400 application is incorporated by reference.

BACKGROUND OF THE INVENTION

This invention relates to improving the properties of minerals rich in carbon such as coal, shale oil, crude oil, peat and fractions thereof, including particularly petroleum gas oils, specifically heavy vacuum gas oils. It more particularly refers to a novel method of reducing the ash content, increasing the specific caloric value, that is the number of calories available per unit of weight, and improving the fluidity of such carbonaceous materials. It still further refers to a novel technique for reducing the oxygen, and if present the metal, content of such carbonaceous materials.

PRIOR ART

It has long been known that coal and other highly carbonaceous minerals are in abundant supply both in the United States and elsewhere. However, except for some research and demonstration type operations, coal and similar materials find use in the United States and in many other industrialized countries, only in the boiler fuel market.

One of the problems with coal is that it is a solid. Another is that it has a very high ash content. Both of the deficiencies carry over, to a greater or lesser extent, to the heavy fractions of crude oil, particularly the gas oils and resids, and most especially to the vacuum gas oils and atmospheric resids boiling upwards of about 650° F. at atmospheric pressure, and vacuum resid fractions boiling in excess of about 1200° F. at atmospheric pressure.

Workers in this field have tried for generations to convert coal, shale oil and other heavier petroleum and petroleum-like stocks to more useful, preferably lighter hydrocarbonaceous materials. Most of these efforts fall into two (2) categories: Direct liquefaction usually involves forcing hydrogen into the hydrocarbon to increase the hydrogen to carbon ratio, to break (hydrocrack) some of the larger molecules down and incidentally to remove some of the oxygen. Indirect conversion usually involves partial oxidation of the feed into synthesis gas—carbon monoxide and hydrogen—which is then suitably converted to more useful products such as by methanol synthesis or Fischer-Tropsche synthesis into alcohols or lower and mid-range hydrocarbons respectively.

While low grade gasoline and other transportation fuels are produced by the Fischer-Tropsche process, these must generally be further refined to make high quality marketable products. The alcohols from methanol synthesis can be used directly as chemicals or as feed-stock to petrocemical processing, or as transportation fuels. They can also be converted to suitable hydrocarbons through the use of known zeolite catalysis.

Political expediencies and local economic conditions have caused transportation fuels to be made by both of these techniques in various parts of the world. However, neither is economically efficient nor can either compete on an equal footing with conventional petroleum refining of crude oil.

Heavy petroleum fractions are often used as feedstock to further refining processes, such as catalytic cracking. The extent to which such fractions can be used is often limited by the metals content thereof, particularly the nickel and vanadium contnets of these fractions.

OBJECTS

It is an object of this invention to provide means to improve both the physical and chemical properties of hydrocarbonaceous materials, particularly coal, shale oil and heavy petroleum fractions.

It is another object of this invention to provide means to reduce the oxygen content of hydrocarbonaceous materials.

It is a further object of this invention to provide means to reduce the ash content of hydrocarbonaceous materials.

It is a still further object of this invention to provide means to reduce the metals content of hydrocarbonaceous materials.

It is a still further object of this invention to increase the specific energy of hydrocarbonaceous materials by refining such to increase the number of calories per unit of weight thereof.

Other and additional object of this invention will appear from a consideration of this entire specification.

SUMMARY OF THE INVENTION

In accord with and fulfilling these objects, this invention envisions reacting hydrocarbonaceous materials containing bound oxygen, with a source of an oxygen reactive element, other than hydrogen or oxygen itself, which has a bond strength, as a diatomic molecule with oxygen, of at least 115 kcal/mol.

The source of the oxygen-reactive element may be the unbonded element itself, or it may be a compound of the element with itself or with other moieties. Where the source of the oxygen-reactive element is a compound which includes the element, the moiety, or moieties to which the oxygen-reactive element is bound must include at least one which has a bond strength, with the element, which is lower, preferably substantially lower, than the bond strength of the oxygen-reactive element with oxygen as aforesaid.

In accord with a preferred aspect of this invention, the bond energy of a diatomic molecule of the oxygen-reactive element and oxygen should be at least about 150 kcal/mol. It is important in the practice of this invention, that the bond energy of the oxygen-reactive element with oxygen should be higher than the bond energy of the oxygen with at least some of whatever moieties to which it is bound in the molecule(s) in which it exists in the hydrocarbonaceous composition being treated. Suitably, the energy of the oxygen bonds in the hydrocarbonaceous composition being treated should be at least about 10% lower, preferably at least about 25% lower, than the bond energy of oxygen with the oxygen reactive element. The specific oxygen-reactive element required to be used in this process can therefore be varied as a function of the nature of the moiety to which the oxygen is bound in the hydrocarbonaceous composition.

The amount of the oxygen-reactive element which should be used in the practice of this invention is, of course, related to the number of bonds available in this element for reaction with oxygen, to the amount of oxygen in the hydrocarbonaceous composition, and to the proportion of oxygen in the hydrocarbonaceous composition sought to be removed therefrom. Often, this latter condition is economic in nature. It is probably best to remove all of the oxygen from the hydrocarbonaceous composition. However, the cost of the source of the oxygen-reactive element is a factor which must be taken into consideration when determining which element is to be used, and how much of the oxygen in the hydrocarbonaceous composition is to be removed.

Once the underlying principals of this invention are made known to those of routine skill in the hydrocarbon conversion art, selecting the appropriate proportion of the appropriate source of the oxygen-reactive element will be easily accomplished by conventional economic calculations. It is believed that it will be preferred to utilize an amount of oxygen-reactive element which is sufficient to extract at least about 50% of the bound oxygen in the hydrocarbonaceous composition, most preferably about 75 to 100%. In order to accomplish this, it will likely be necessary to feed more of the source of the oxygen-reactive element than is stoichiometrically equal to the proportion of oxygen which it is desired to extract from the hydrocarbonaceous composition, suitably at least about 2% excess, most preferably at least about 10% excess.

Compounds suited to use in this invention as a source of the oxygen-reactive element include compounds where some, but not all, of the bonds of the element are occupied by oxygen itself, so long as there remain some available bonds of the oxygen-reactive element which can later react with oxygen. Therefore, using silicon as a preferred example of the oxygen-reactive elements which are useful in this invention, representative examples of the type of source materials which may be used in this invention are: metallic silicon, silane, alkyl substituted silanes, partially alkoxy substituted silanes, an other similar organic or inorganic substituted compounds.

DETAILED DESCRIPTION OF THIS INVENTION

Examples of the oxygen reactive elements, in addition to the preferred silicon, to which this invention is directed include aluminum, germanium and arsenic. Other elements are also to be considered to be included within the scope of this invention, provided they meet with the above set forth criteria.

For the remainder of this specification, this invention will be exemplified by descriptions which use silicon as the exemplary oxygen-reactive element. It is to be understood that in this regard silicon is exemplary of and not limiting on the instant invention.

The treatment of the hydrocarbonaceous compositions, according to this invention, should be carried out under conditions sufficient to permit the silicon to react with the bound oxygen, and so to extract oxygen from the hydrocarbonaceous material. It is known that oxygenated hydrocarbonaceous materials become more liquid, more petroleum-like, and more highly caloric as their oxygen content is reduced. Thus the process of this invention comprises contacting a hydrocarbonaceous material containing bound oxygen with a source of reactive silicon in an amount and under conditions sufficient to permit and encourage reaction between the reactive silicon species and the oxygen combined in the hydrocarbonaceous material.

The amount of reactive silicon should be at least sufficient to extract enough to cause an increase in the fluidity and a reduction in the ash content of the feed hydrocarbonaceous material. Since this reaction, of combined oxygen with reactive formation of metal silicates, each reactive silicon atom could extract up to four (4) oxygen atoms from the hydrocarbonaceous feed material. It is known that siloxanes show a stoichiometry of four (4) oxygen atoms per silicon atom, but the formation of siloxanes, particularly organic siloxanes which are readily separable from the hydrocarbonaceous material product, is unlikely. It can be expected that the silicon oxygen reaction product resulting from the process of this invention will have a stoichiometry of at least about two (2) oxygens per silicon. Thus the ratio of added reactive available silicon to combined oxygen most preferably should be about one mole of reactive silicon to two (2) moles of combined oxygen. Of course it is within the scope of this invention to use or more less reactive silicon. In fact, since it is within the scope of this invention to feed silicon compounds which already contain some oxygen, although not as much as to account for all of the valence sites of the reactant silicon, the mole ratio of reactive silicon to combined oxygen must take into account only so much of the fed silicon compound as is still available for further extraction of the oxygen combined in the hydrocarbonaceous feed.

Mole ratios of reactive silicon to combined oxygen in excess of 0.5 are contemplated by this invention. However, at present no particular advantage is apparent from such high ratios. A very low ratio of reactive silicon to combined oxygen might be used if it is desired merely to slightly reduce the oxygen content of the hydrocarbonaceous feed without significantly altering its other compositional characteristics.

In this regard it is important to note that a preferred aspect of this invention requires the exclusion from the reaction zone of sources of oxygen other than that which is combined in the hydrocarbonaceous feed material and other than that which is already combined with the oxygen reactive element, that is the silicon reactant. Thus steam and air should preferably be excluded. If required or desired, an inert gas blanket or fluidizing means may be used. Nitrogen, methane or other light hydrocarbonaceous stream, such as LPG, are suitable.

Sources of reactive silicon are at present expensive to obtain. Therefor, the quantity thereof should be limited to no more than the minimum that is needed to convert the hydrocarbonaceous feed material to the desired product. The characteristics of the desired product will of course be determined by its intended use.

If resid is being treated by this invention to improve its value as boiler fuel, it may only be necessary to remove a small amount of combined oxygen and/or metal so as to reduce its potential ash make, and to increase its fluidity. If, on the other hand it is desired to convert hard coal to a material which is suitable for feed to a cat cracker, relatively thorough oxygen and metals removal, by using appropriately higher proportion of reactive silicon, may be in order.

Silicon reacts readily with oxygen. It is believed that this reaction is quite exothermic. Therefore, externally induced elevated temperatures may not be necessary to induce this reaction to start. Since it is well known that increasing temperature increases rate of reaction, carrying out the instant process at elevated temperatures is contemplated. Although the reaction temperature does not appear to be critical, exemplary temperatures include about 100° to 1500° F. Heat exchange may be important in order to remove the exothermic heat of reaction and maintain the reaction zone in a thermodynamic steady state condition. Conventional heat exchange techniques, such as the use of tubular reactors surrounded by heat exchange fluids, can be used. Cooled recycle and/or either fixed fluidized or fluidized transport risers and known techniques for controlling reaction temperature which might find use in this invention. Direct heat exchange, for example with cooled silica, particles might be used.

Under some circumstances, silicon reacts with oxygen with explosive rapidity. Care should be taken to provide pressure reduction and heat removal conditions to accommodate this potential problem. There does not appear to be an operating pressure limitation on this process. Pressures may range from vacuum to superatmospheric depending upon normal chemical engineering process control and operation guidelines.

The reaction between silicon and oxygen has been identified as an exothermic reaction. The reaction between a feed comprising an oxygen containing hydrocarbonaceous fraction and a feed comprising a silicon containing fraction which has a stoichiometric deficiency of oxygen will also be exothermic.

Under steady state conditions, the heat generated by practicing the process of this invention must be removed from the reaction zone in direct proportion to its generation so as to maintain the reaction zone in a condition of thermal equilibrium. Heat removal from reaction zones is well known in the chemical and petroleum processing arts.

Steam generation is one well known technique of removing heat. This is often accomplished by utilizing a reaction zone which is also designed as an indirect heat exchanger. In this type of operation, water is fed on one side of the heat exchanger, suitably into coils disposed at strategic locations in the reaction zone, and it is converted to steam by the exothermic heat generated in the reaction. The steam is recovered and used in a conventional manner, such as the generation of electricity. The use of such generated steam is per se well known.

It is also practical to remove heat from the process of this invention by feeding oxygen-deficient silicon containing feed cold to the reaction zone, and/or to use some of the exothermic reaction heat to heat the hydrocarbonaceous feed to reaction temperature. In general, this type of engineering expedient is per se known and is commercially practiced in petroleum hydrocracking, which is quite exothermic, by feeding cold hydrogen to the reaction zone. Analagous to the practice in hydrocracking, the cold silicon containing feed can be introduced into the reaction zone at multiple points. This allows the exothermic deoxygenation reaction to be better thermally controlled to prevent or at least retard the possibility of a thermal runaway reaction.

Another heat removal technique takes advantage of the fact that the more highly oxygenated silicon product produced is at an elevated temperature. It is also immiscible with the less oxygenated hydrocarbonaceous product and with the feed, at least to some extent. These fractions are therefore separable by physical means, e.g. decantation, distillation, flashing, or the like. By removing the hot siliceous product and cooling it outside the reaction zone, heat is removed thus making it possible to preserve the thermal equilibrium in the reaction zone.

Further, it is contemplated that the exothermic heat of reaction generated in the deoxygenation reaction described herein can be used positively either directly or indirectly, to support a simultaneous endothermic reaction, such as catalytic cracking. The oxygenated hydrocarbonaceous feed material, as well as the deoxygenated hydrocarbonaceous product fraction, are contemplated to be rather heavy fractions. The product is contemplated for use directly as boiler fuel or for feed to an endothermic catalytic cracker.

Therefore it is considered to be a part of this invention to provide in the reaction zone of the process hereof a suitable catalyst for the catalytic cracking of hydrocarbonaceous fractions. Under these circumstances, the process hereof should be allowed to reach thermal equilibrium at a temperature high enough to support catalytic cracking, such as for example about 900° to 1100° F. Higher or lower temperatures may be used as appropriate. Catalysts for use in supporting catalytic cracking are per se well known and widely commercially available materials. It is common for these catalysts to comprise alumino-silicate acidic solids such as zeolitic behaving materials and amorphous silica-alumina. Other such catalytic materials are well known.

By combining the deoxygenation of oxygenated hydrocarbonaceous feeds and the catalytic cracking of either the feeds or the deoxygenated hydrocarbonaceous products, it is possible to produce a more desirable and valuable product distribution. It is also contemplated to augment the oxygenated hydrocarbonaceous feed with more conventional cracker feed, such as for example vacuum gas oil.

The nature of the reactive silicon species that is useful in this invention can vary widely. Silicon metal and silane are probably the most reactive and most efficient species available. However, these materials are quite expensive and great care must be taken with them to insure that they do not prematurely decompose or react with environmental oxygen, or react with the hydrocarbonaceous feed too violently. If available, scrap silicon metal and impure silane are useful because they are much cheaper. Derivatives of silane are useful, such as oxygen deficient siloxanes and silicones, particularly hydrocarbon derivatives, most particularly silane or alkyl substituted silanes. Scrap silicon products, such as polymer oils, are useful as are other non- or incompletely oxygenated silicon compounds.

It is within the contemplation of this invention to recover the silicon-oxygen compounds produced by this process and to reconstitute reactive silicon species therefrom. There are many well known techniques for converting silica and silicates to silicon metal and/or silanes. Reference is here made to the Kirk-Othmer Encyclopedia of Chemical Technology, Volume 20 for the state of the art in producing silicon metal and silanes as well as other reactive silicon species.

The most preferred implementation of this process comprises reacting silane with finely comminuted coal or vacuum gas oil in a molar proportion of up to one mole of silane ($SiH_4$) for every two moles of oxygen, measured as ash, in the feed at about 500° F. (start of cycle) under a hydrogen or hydrocarbon atmosphere blanket at a pressure of about 100 psig in the presence of a convention zeolite based hydrocracking catalyst, such as platinum and a petroleum like product at least a portion of which boils at a lower temperature than the feed, suitably about 1000° F., or less, is deficient in oxygen, enriched in hydrogen, has a lower boiling range than the original feed, and is more fluid than the original feed; and separating the silicon-oxygen containing compound and so produced from the petroleum like hydrocarbonaceous product. Preferably, the product silicon-oxygen containing compound(s), or at least a portion thereof is subjected to regeneration whereby compound(s) containing silicon which have a stoichiometric deficiency of oxygen are produced, and recycled to the instant desired reaction process.

What is claimed is:

1. A process of refining a composition comprising hydrocarbonaceous material containing chemically combined oxygen, which comprises reacting such composition with a source of at least one oxygen-reactive element, except oxygen and hydrogen, having a bond energy, of a diatomic molecule of oxygen and said element, of at least about 115 kcal/mol, and having a stoichiometric deficiency of oxygen bound thereto, under a combination of reaction conditions, including at least elevated temperature, sufficient to produce a product comprising a first fraction, comprising at least one less highly oxygenated hydrocarbonaceous material; and a second fraction comprising at least one more highly oxygenated compound of said oxygen-reactive element.

2. A process as claimed in claim 1 carried out in the substantial absence of an oxygen containing material other than said hydrocarbonaceous material.

3. A process as claimed in claim 1 wherein said bond energy is at least about 10% higher than the bond energy of said bound oxygen in said hydrocarbonaceous composition.

4. A process as claimed in claim 1 wherein said element is at least one selected from the group consisting of silicon, aluminum, germanium and arsenic.

5. A process as claimed in claim 4 wherein said oxygen-reactive element comprises a silane or an aluminum alkyl.

6. A process as claimed in claim 4 wherein said silicon containing compound is an oxygen deficient siloxane or silicone.

7. A process as claimed in claim 4 wherein said silicon containing compound is an oxygen deficient silicon polymer.

8. A process as claimed in claim 1 carried out under conditions sufficient to rapidly remove heat therefrom.

9. A process as claimed in claim 1 wherein said feed hydrocarbonaceous material is coal and wherein at least some of said hydrocarbonaceous product is liquid at temperatures up to about 1000° F. at atmospheric pressure.

10. A process as claimed in claim wherein said feed hydrocarbonaceous material is crude oil.

11. A process as claimed in claim 1 wherein said feed hydrocarbonaceous material is a petroleum atmospheric resid.

12. A process as claimed in claim 4 wherein said feed hydrocarbonaceous material contains metal values and wherein said second fraction of said product contains metal silicates.

13. A process as claimed in claim 4 wherein said feed silicon containing moiety contains reactive hydrogen and wherein the hydrocarbonaceous product species has a higher hydrogen to carbon ratio, a lower oxygen to carbon ratio and a lower metal to carbon ratio than did said hydrocarbonaceous material feed.

14. A process as claimed in claim 1 carried out at elevated pressure under an atmosphere comprising hydrogen.

15. A process as claimed in claim 1 carried out at about 100° to 1500° F. under heat extraction conditions.

16. A process as claimed in claim 1 including subsequent steps of separating at least some of said oxygen from said more highly oxygenated oxygen-reactive element to produce at least a portion of said source of oxygen-reactive element.

17. A process as claimed in claim 1 carried out in effective contact with a catalytic cracking catalyst under conditions effective to catalytically crack said less highly oxygenated hydrocarbonaceous product.

18. A process as claimed in claim 17 wherein said catalyst comprises an acidic zeolitic behaving material.

* * * * *